US009799999B1

(12) United States Patent
Tsai et al.

(10) Patent No.: US 9,799,999 B1
(45) Date of Patent: Oct. 24, 2017

(54) ELECTRICAL RECEPTACLE CONNECTOR

(71) Applicant: Advanced-Connectek Inc., New Taipei (TW)

(72) Inventors: Yu Lun Tsai, New Taipei (TW); Pin Yuan Hou, New Taipei (TW); Chung Fu Liao, New Taipei (TW); Hsien Lung Huang, New Taipei (TW); Hsu-Fen Wang, New Taipei (TW); Chien Tsung Chuang, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 15/604,948

(22) Filed: May 25, 2017

(30) Foreign Application Priority Data

May 27, 2016 (TW) ..... 105207877 U

(51) Int. Cl.

| | |
|---|---|
| ***H01R 24/00*** | (2011.01) |
| ***H01R 24/60*** | (2011.01) |
| ***H01R 4/02*** | (2006.01) |
| ***H01R 13/6471*** | (2011.01) |
| ***H01R 13/6585*** | (2011.01) |
| *H01R 107/00* | (2006.01) |

(52) U.S. Cl.
CPC ..... *H01R 24/60* (2013.01); *H01R 4/02* (2013.01); *H01R 13/6471* (2013.01); *H01R 13/6585* (2013.01); *H01R 2107/00* (2013.01)

(58) Field of Classification Search
CPC ..... H01R 23/02; H01R 24/60; H01R 24/62
USPC ..... 439/660
See application file for complete search history.

(56) References Cited

U.S. PATENT DOCUMENTS

| | | | | |
|---|---|---|---|---|
| 8,079,854 | B2 * | 12/2011 | He | H01R 13/6467 439/108 |
| 8,162,671 | B2 * | 4/2012 | Matsubara | H01R 12/724 439/60 |
| 8,376,785 | B2 * | 2/2013 | Lapidot | H01R 13/6461 439/60 |
| 8,662,936 | B2 * | 3/2014 | Chung | H01R 13/6471 439/607.35 |
| 9,083,134 | B2 * | 7/2015 | Chen | H01R 13/6471 |
| 9,136,649 | B2 * | 9/2015 | Shih | H01R 13/658 |

* cited by examiner

*Primary Examiner* — Phuong Dinh
(74) *Attorney, Agent, or Firm* — Ming Chow; Sinorica, LLC

(57) ABSTRACT

An electrical receptacle connector has an insulated housing. A first terminal set and a second terminal set are held in the insulated housing. The first terminal set has two first grounding terminals, two first power terminals and multiple signal terminals. Each one of the terminals of the first terminal set has a first soldering section. The second terminal set has two second grounding terminals, two second power terminals and multiple signal terminals. Each one of the terminals of the second terminal set has a second soldering section. The second soldering sections of the second grounding terminals are located next to the first soldering sections of the first grounding terminals. The second soldering sections of the second power terminals are located next to the first soldering sections of the first power terminals. A soldering process of the connecter is improved by clustering the grounding terminals and the power terminals.

18 Claims, 17 Drawing Sheets

ELECTRICAL RECEPTACLE CONNECTOR

CROSS-REFERENCE TO RELATED APPLICATIONS

This application is based upon and claims priority under 35 U.S.C. 119 from Taiwan Patent Application No. 105207877 filed on May 27, 2016, which is hereby specifically incorporated herein by this reference thereto.

BACKGROUND OF THE INVENTION

1. Field of the Invention

The instant disclosure relates to an electrical receptacle connector, and more particularly to the electrical receptacle connector that soldering sections of multiple terminals are arranged in a single row so as to improve the soldering process, increase yield rates and prevent the solder skip or short circuit during the soldering process.

2. Description of the Prior Art(s)

A connector is a common electronic component mounted on an electronic device, and is connected to another matching connector that is mounted on another electronic device. Therefore, the two connectors provide the signal transmission and the power transmission between the two electronic devices. One kind of conventional connector is a "Universal Serial Bus (USB) 3.1" connector. The communication protocol of USB 3.1 further adds the specification of "Type C" connector. Thus, the conventional connector of USB 3.1 provides a super high data transmission rate in 10 Gbps. Moreover, the dimensions of the conventional connector of USB 3.1 are reduced for being mounted on the cellular phone or other mobile devices. Besides, the interface plug of the connector of USB 3.1 is symmetrical. Thus, the connector of USB 3.1 can be inserted reversely and therefore can be widely used in various electronic devices.

The connector of USB Type C has an insulated housing, two terminal sets, and a metal case. The insulated housing is made of plastic and has a tongue portion that extends from the insulated housing. The two terminal sets are mounted on the tongue portion for signal transmission. Each one of the terminal sets has multiple terminals. Each one of the terminals has a soldering section that is soldered on a circuit board.

However, the two terminal sets are aligned with each other in two rows. The soldering sections that have identical pin assignments in grounding terminals or power terminals are respectively soldered. Therefore, the soldering process of the terminal set is complicated. Meanwhile, the soldering process has problems of solder skip or short circuit. Thus, a yield rate of the conventional connector is decreased.

SUMMARY OF THE INVENTION

The instant disclosure provides electrical receptacle connector that soldering sections of multiple terminals are arranged in a single row so as to improve soldering process, increase yield rates and prevent the solder skip or short circuit during the soldering process.

To achieve the foregoing objective, the electrical receptacle connector has an insulated housing, a first terminal set, a second terminal set and a metallic shell. The insulated housing has a base portion and a tongue portion. The tongue portion extends from the base portion. The first terminal set is held in the insulated housing, disposed on a top surface of the tongue portion and has two first grounding terminals, two first power terminals and multiple first signal terminals.

Each one of the first grounding terminals, the first power terminals and the first signal terminals respectively has a first connection section, a first soldering section and a first contact section. The first soldering section extends from one of two ends of the first connection section. The two first soldering sections of the two first grounding terminals are respectively located on a far left and a far right of the first terminal set. The two first soldering sections of the two first power terminals are disposed between the two first soldering sections of the two first grounding terminals and are respectively located next to the two first soldering sections of the two first grounding terminals. The first contact section extends from the other end of the first connection section. The second terminal set is held in the insulated housing, disposed on a bottom surface of the tongue portion and has two second grounding terminals, two second power terminals and multiple second signal terminals. Each one of the second grounding terminals, the second power terminals and the second signal terminals has a second connection section, a second soldering section and a second contact section. The second soldering section extends from one of two ends of the second connection section. The two second soldering sections of the two second grounding terminals are respectively located on a far left and a far right of the second terminal set. The two second soldering sections of the two second power terminals are disposed between the two second soldering sections of the two second grounding terminals and are respectively located next to the two second soldering sections of the two second grounding terminals. The second soldering sections of the second terminal set are aligned with the first soldering sections of the first terminal set at a same horizontal plane. The two second soldering sections of the two second grounding terminals are respectively located adjacent to the two first soldering sections of the two first grounding terminals. The two second soldering sections of the two second power terminals are respectively located adjacent to the two first soldering sections of the two first power terminals. The second contact section extends from the other end of the second connection section. The metallic shell surrounds the insulated housing and has a receiving cavity. The receiving cavity is defined through the metallic shell and receives the insulated housing, the first terminal set and the second terminal set.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
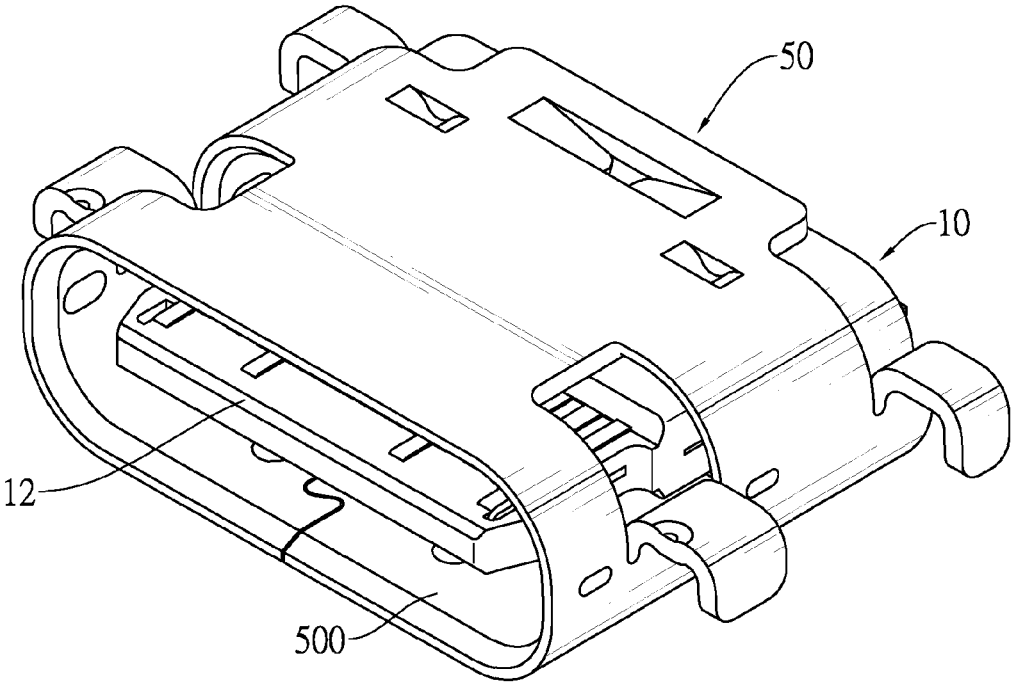
FIG. 1 is a perspective view of a first embodiment of an electrical receptacle connector in accordance with the instant disclosure.
Figure 2:
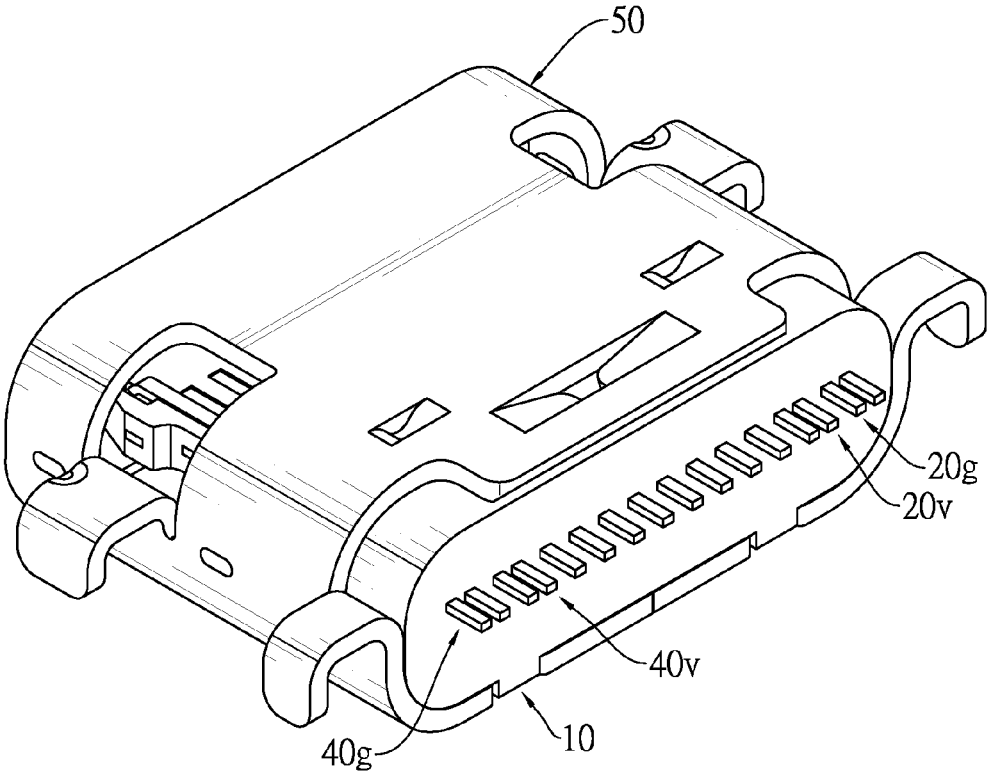
FIG. 2 is another perspective view of the first embodiment of the instant disclosure in FIG. 1.
Figure 3:
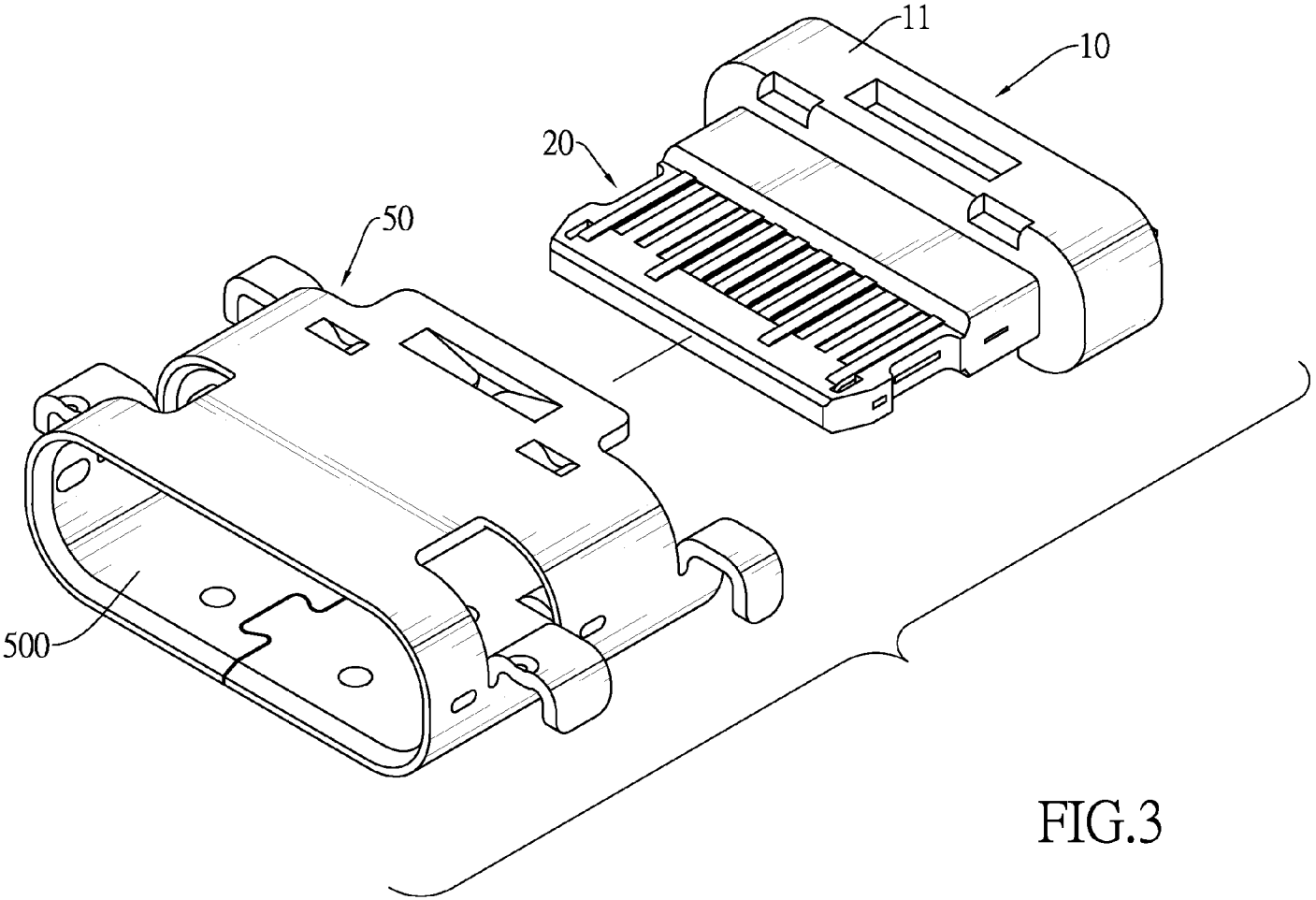
FIG. 3 is an exploded perspective view of the first embodiment of the instant disclosure in FIG. 1.
Figure 4:
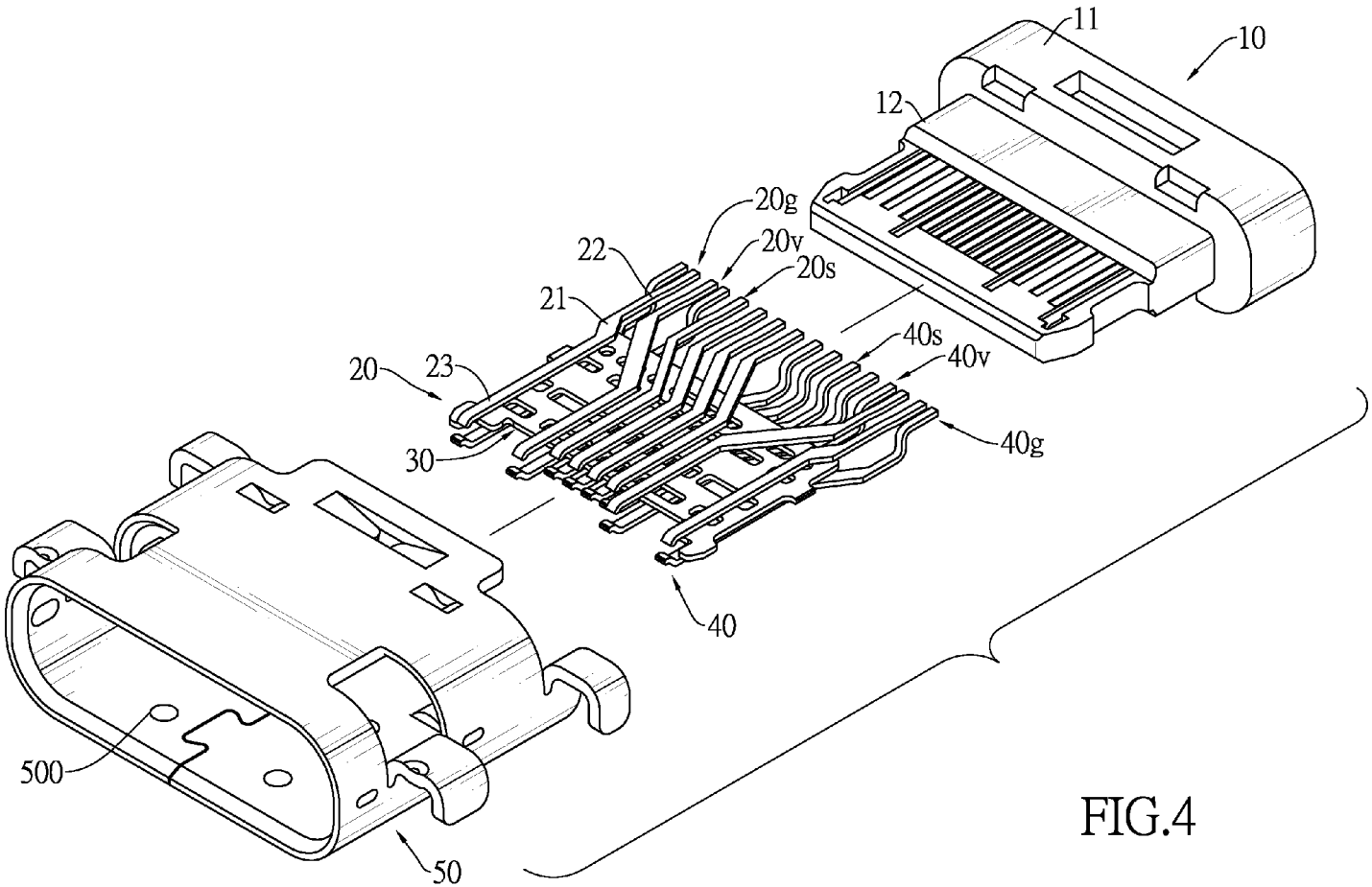
FIG. 4 is an exploded perspective view of the first embodiment of the instant disclosure in FIG. 3, showing that a first terminal set, a second terminal set and a shielding plate disassembled from an insulated housing.

With reference to FIGS. 1 to 4, an electrical receptacle connector in accordance with the instant disclosure is accommodated to a Universal Serial Bus Type-C Cable and Connector Specification. The electrical receptacle connector includes an insulated housing 10, a first terminal set 20, a shielding plate 30, a second terminal set 40 and a metallic shell 50.

The insulated housing 10 has a base portion 11 and a tongue portion 12.

The tongue portion 12 protrudes from the base portion 11.

The first terminal set 20 is held in the insulated housing 10 and includes two first grounding terminals 20*g*, two first power terminals 20*v* and multiple first signal terminals 20*s*.

Each one of the first grounding terminals 20*g*, the first power terminals 20*v* and the first signal terminals 20*s* respectively has a first connection section 21, a first soldering section 22 and a first contact section 23.

The first soldering section 22 extends from one of two ends of the first connection section 21. The two first soldering sections 22 of the two first grounding terminals 20*g* are respectively located on a far left and a far right of the first terminal set 20. The two first soldering sections 22 of the two first power terminals 20*v* are disposed between the two first soldering sections 22 of the two first grounding terminals 20*g* and are respectively located next to the two first soldering sections 22 of the two first grounding terminals 20*g*. The first soldering sections 22 of the first terminal set 20 are arranged in a single row and protrude out of the base portion 11. Furthermore, the first soldering sections 22 of the first signal terminals 20*s* are clustered together. In other words, the first signal terminals 20*s* are located next to each other.

The first contact section 23 extends from the other end of the first connection section 21. The first contact sections 23 of the first terminal set 20 are disposed on a top surface of the tongue portion 12.

The shielding plate 30 is embedded inside the insulated housing 10 and is located between the first terminal set 20 and the second terminal set 40.

The second terminal set 40 is held in the insulated housing 10 and includes two second grounding terminals 40*g*, two second power terminals 40*v* and multiple second signal terminals 40*s*.

Each one of the second grounding terminals 40*g*, the second power terminals 40*v* and the second signal terminals 40*s* has a second connection section 41, a second soldering section 42 and a second contact section 43.

The second soldering section 42 extends from one of two ends of the second connection section 41. The two second soldering sections 42 of the two second grounding terminals 40*g* are respectively located on a far left and the a right of the second terminal set 40. The two second soldering sections 42 of the two second power terminals 40*v* are disposed between the two second soldering sections 42 of the two second grounding terminals 40*g* and are respectively located next to the two second soldering sections 42 of the two second grounding terminals 40*g*. The second soldering sections 42 of the second terminal set 40 are arranged in a single row and protrude out of the base portion 11. Furthermore, the second soldering sections 42 of the second signal terminals 40*s* are clustered together. In other words, the second signal terminals 40*s* are located next to each other.

The second contact section 43 extends from the other end of the second connection section 41. The second contact sections 43 of the second terminal set 40 are disposed on a bottom surface of the tongue portion 12.

Figure 7:
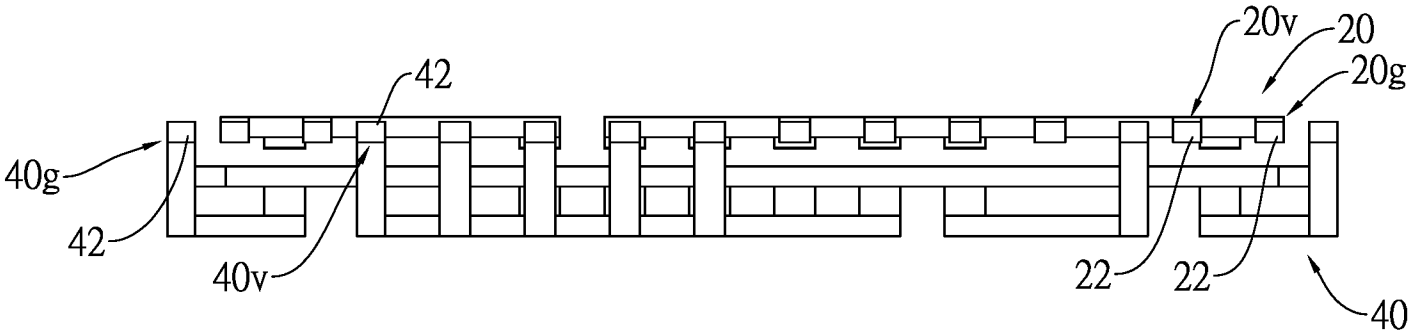
FIG. 7 in a back view of the first terminal set, the second terminal set and the shielding plate of the first embodiment of the invention in FIG. 5.

With reference to FIG. 7, the second soldering sections 42 of the second terminal set 40 are aligned with the first soldering sections 22 of the first terminal set 20 at a same horizontal plane. The two second soldering sections 42 of the two second grounding terminals 40*g* are respectively located adjacent to the two first soldering sections 22 of the two first grounding terminals 20*g*. The two second soldering sections 42 of the two second power terminals 40*v* are respectively located adjacent to the two first soldering sections 22 of the two first power terminals 20*v*.

The metallic shell 50 surrounds the insulated housing 10 and has a receiving cavity 500.

The receiving cavity 500 is defined through the metallic shell 50 and receives the insulated housing 10, the first terminal set 20 and the second terminal set 40.

Figure 5:
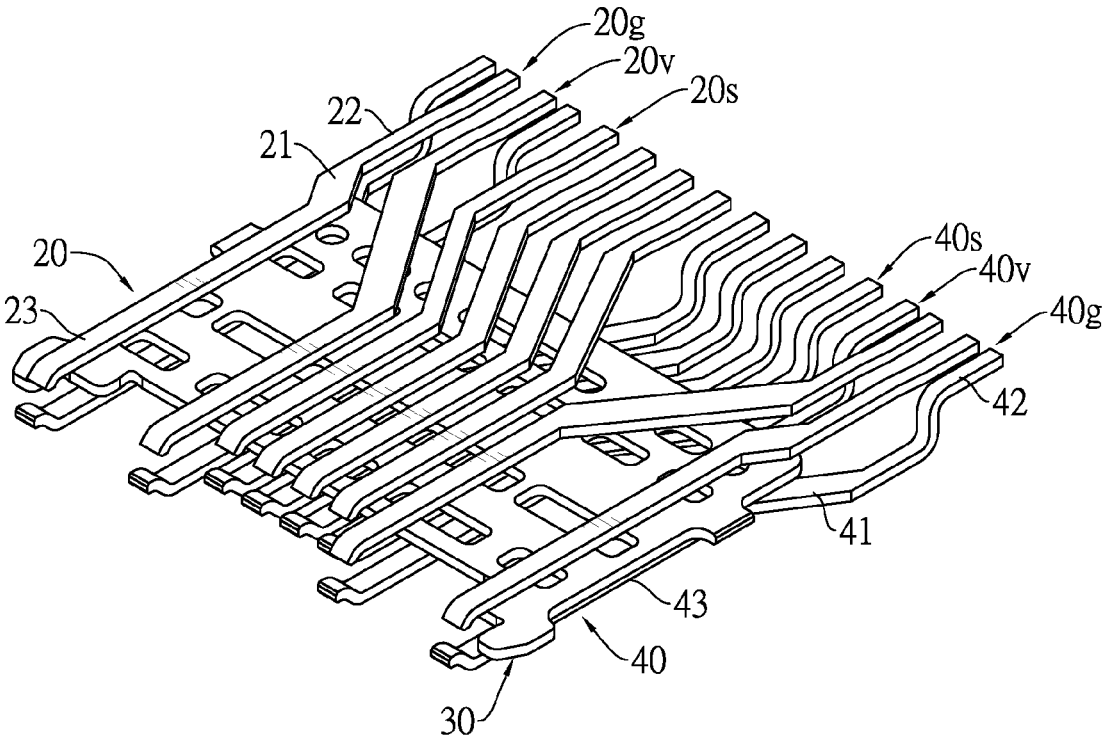
FIG. 5 is a perspective view of the first terminal set, the second terminal set and the shielding plate of the first embodiment of the instant disclosure in FIG. 4.
Figure 6:
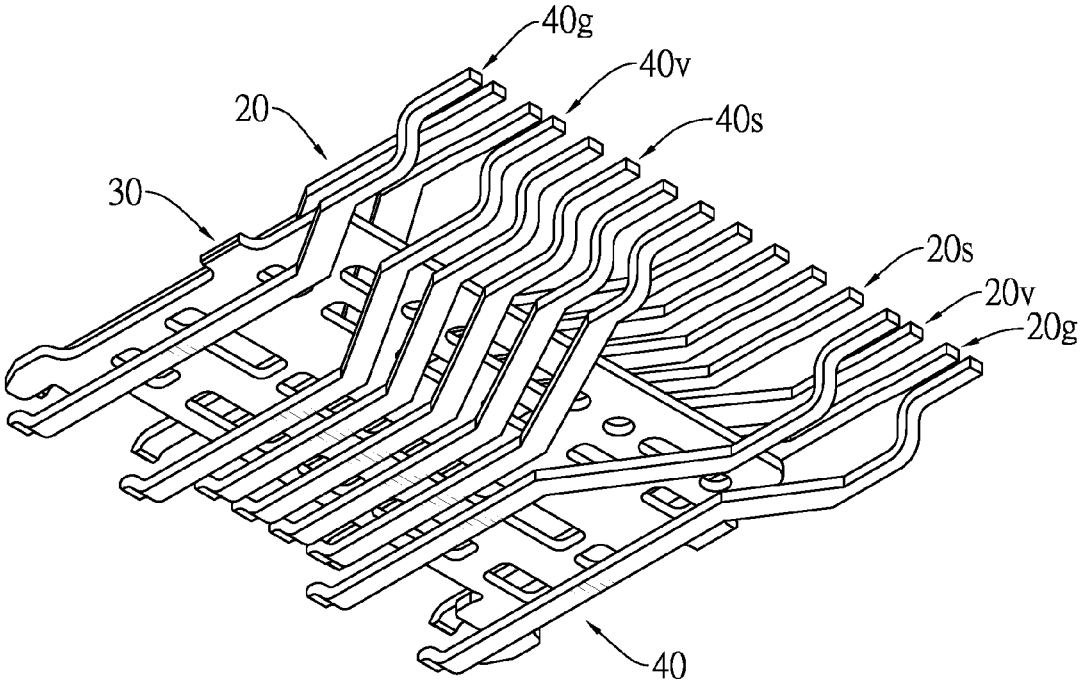
FIG. 6 is another perspective view of the first embodiment of the instant disclosure in FIG. 5.
Figure 8:
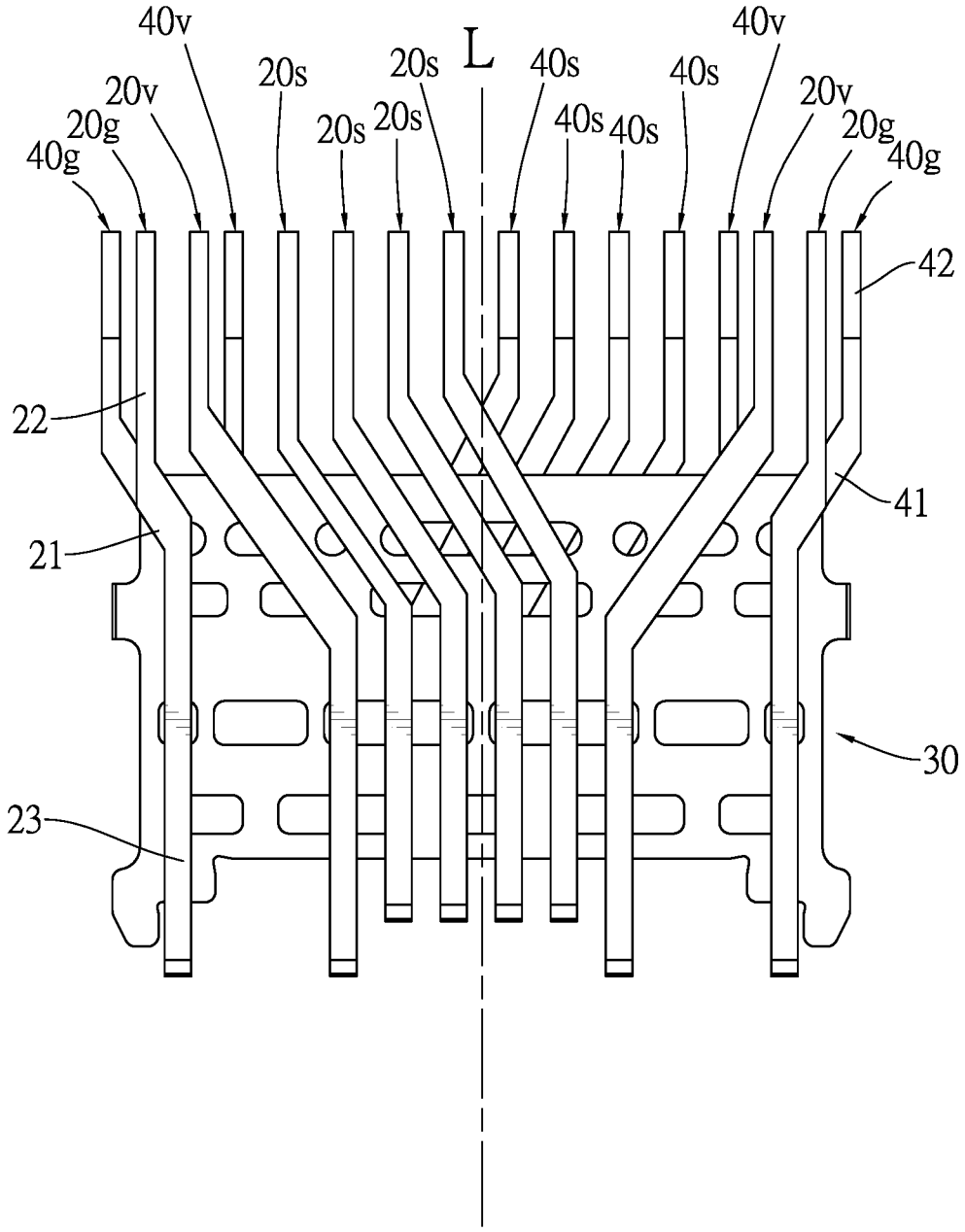
FIG. 8 is a top view of the first terminal set, the second terminal set and the shielding plate of the first embodiment of the invention in FIG. 5.

With reference to FIGS. 5, 6 and 8, in a first embodiment of the instant disclosure, the first soldering section 22 of the first grounding terminal 20*g* and the first soldering section 22 of the first power terminal 20*v* that are located on the far left of the first terminal set 20 are symmetrical with the first soldering section 22 of the first grounding terminal 20*g* and the first soldering section 22 of the first power terminal 20*v* that are located on the far right of the first terminal set 20 along a longitudinal axis L that is located in a center of the electrical receptacle connector.

The second soldering section 42 of the second grounding terminal 40*g* and the second soldering section 42 of the power terminal 40*v* that are located on the far left of the second terminal set 40 are symmetrical with the second soldering section 42 of the second grounding terminal 40*g* and the second soldering section 42 of the second power terminal 40*v* that are located on the far right of the second terminal set 40 along the longitudinal axis L.

The second soldering section 42 of the second grounding terminal 40*g* and the second soldering section 42 of the power terminal 40*v* that are located on the far left of the second terminal set 40 are respectively located at a left side and a right side of the first soldering section 22 of the first grounding terminal 20*g* and the first soldering section 22 of the first power terminal 20*v* that are located on the far left of the first terminal set 20.

The second soldering section 42 of the second grounding terminal 40*g* and the second soldering section 42 of the second power terminal 40*v* that are located on the far right of the second terminal set 40 are respectively located at a left side and a right side of the first soldering section 22 of the first grounding terminal 20*g* and the first soldering section 22 of the first power terminal 20*v* that are located on the far right of the first terminal set 20.

An arrangement of location of the first terminal set 20 and the second terminal set 40 is listed in the following table, from the left side to the right side of the first embodiment in a top view.

A table of position arrangement of the first soldering sections and second soldering sections of the first embodiment

| | | | | | | | | | | | | | | | |
|---|---|---|---|---|---|---|---|---|---|---|---|---|---|---|---|
| $2^{nd}$ Gnd. Tm. | $1^{st}$ Gnd. Tm. | $1^{st}$ Pwr. Tm. | $2^{nd}$ Pwr. Tm. | $1^{st}$ Sig. Tm. | $1^{st}$ Sig. Tm. | $1^{st}$ Sig. Tm. | $1^{st}$ Sig. Tm. | $2^{nd}$ Sig. Tm. | $2^{nd}$ Sig. Tm. | $2^{nd}$ Sig. Tm. | $2^{nd}$ Sig. Tm. | $2^{nd}$ Pwr. Tm. | $1^{st}$ Pwr. Tm. | $1^{st}$ Gnd. Tm. | $2^{nd}$ Gnd. Tm. |

Gnd. as grounding;
Pwr. as power;
Sig. as signal;
Tm. as terminal.

In the first embodiment of the instant disclosure, a sequence of the first and second power terminals 20*v*, 40*v* and the first and second grounding terminals 20*g*, 40*g* with respect to the first soldering sections 22 and the second soldering sections 42 from a left side to a right side of the electrical receptacle connector is the second grounding terminal 40*g*, the first grounding terminal 20*g*, the first power terminal 20*v*, the second power terminal 40*v*, the second power terminal 40*v*, the first power terminal 20*v*, the first grounding terminal 20*g* and the second grounding terminal 40*g*.

Figure 9:
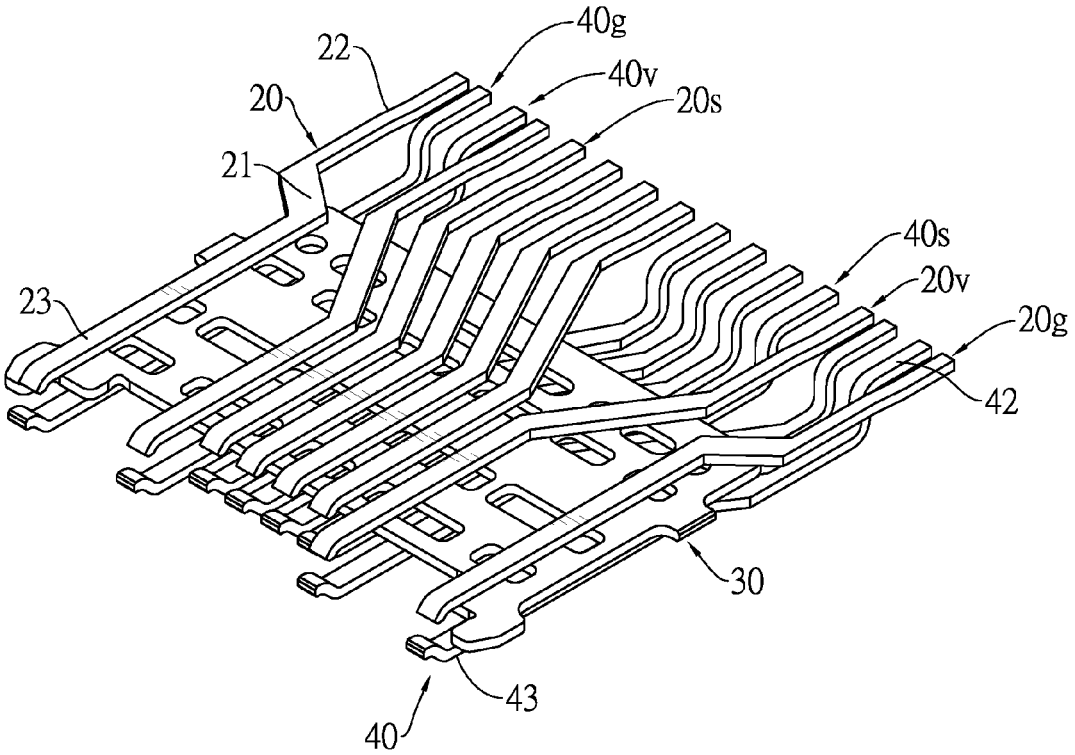
FIG. 9 is a perspective view of a second embodiment of the instant disclosure, showing the first terminal set, the second terminal set and the shielding plate.
Figure 10:
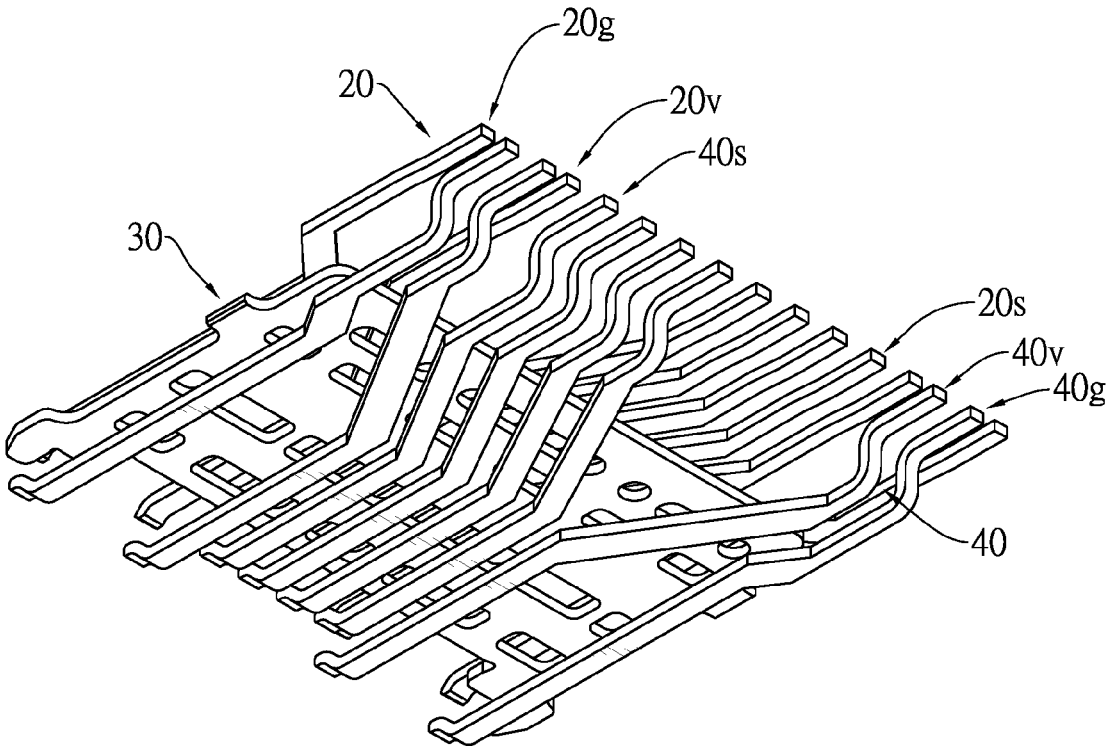
FIG. 10 is another perspective view of the first terminal set, the second terminal set and the shielding plate of the second embodiment of the instant disclosure in FIG. 9.
Figure 11:
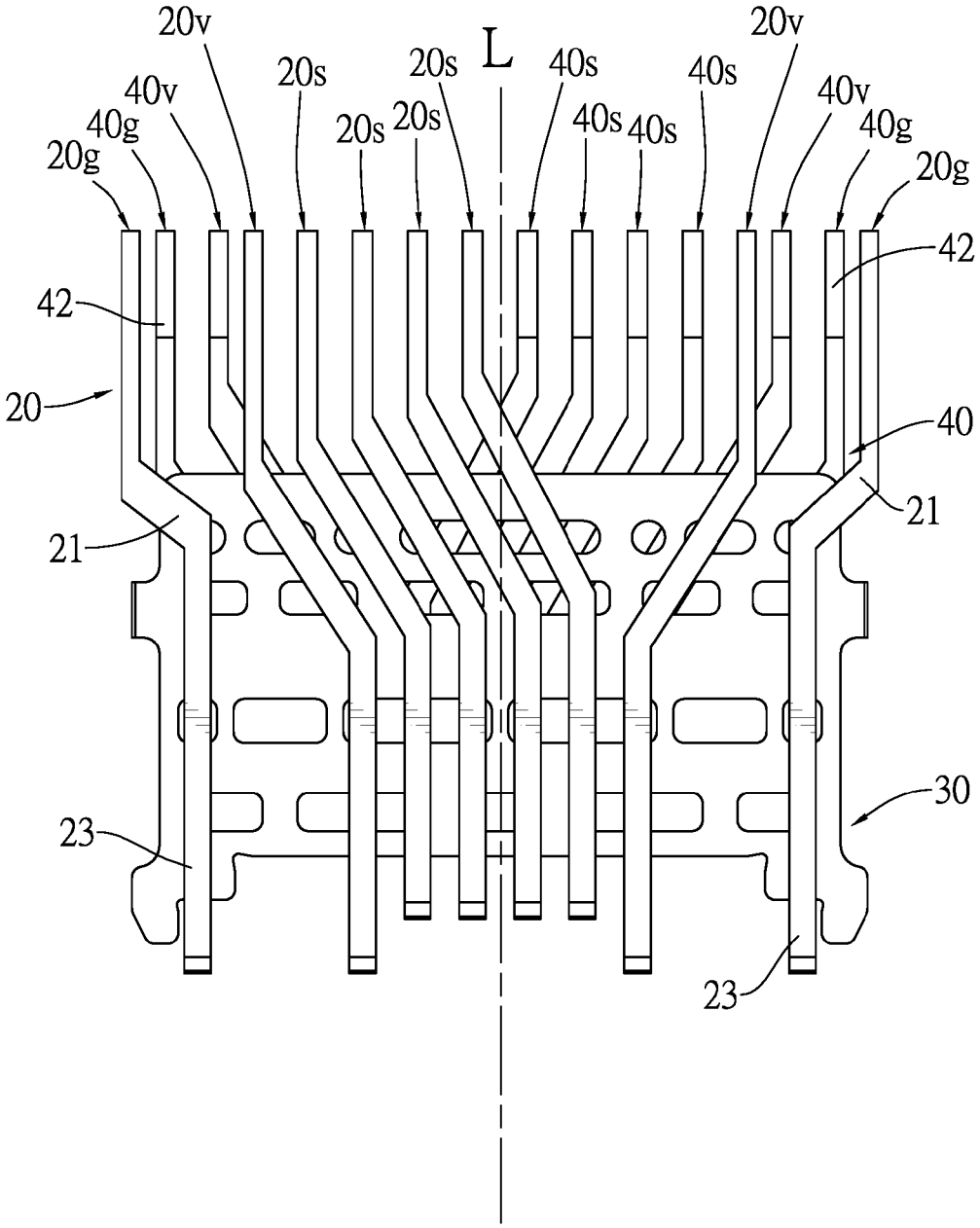
FIG. 11 is a top view of the first terminal set, the second terminal set and the shielding plate of the second embodiment of the instant disclosure in FIG. 9.

With reference to FIGS. 9 to 11, in a second embodiment of the instant disclosure, the first soldering section 22 of the first grounding terminal 20*g* and the first soldering section 22 of the first power terminal 20*v* that are located on the far left of the first terminal set 20 are symmetrical with the first soldering section 22 of the first grounding terminal 20*g* and the first soldering section 22 of the first power terminal 20*v* that are located on the far right of the first terminal set 20 along a longitudinal axis L that is located in a center of the electrical receptacle connector.

The second soldering section 42 of the second grounding terminal 40*g* and the second soldering section 42 of the power terminal 40*v* that are located on the far left of the second terminal set 40 are symmetrical with the second soldering section 42 of the second grounding terminal 40*g* and the second soldering section 42 of the second power terminal 40*v* that are located on the far right of the second terminal set 40 along the longitudinal axis L.

The second soldering section 42 of the second grounding terminal 40*g* and the second soldering section 42 of the second power terminal 40*v* that are located on the far left of the second terminal set 40 are located between the first soldering section 22 of the first grounding terminal 20*g* and the first soldering section 22 of the first power terminal 20*v* that are located on the far left of the first terminal set 20.

The second soldering section 42 of the second grounding terminal 40*g* and the second soldering section 42 of the second power terminal 40*v* that are located on the far right of the second terminal set 40 are located between the first soldering section 22 of the first grounding terminal 20*g* and the first soldering section 22 of the first power terminal 20*v* located on the far right of the first terminal set 20.

An arrangement of location of the first terminal set 20 and the second terminal set 40 is listed in the following table, from the left side to the right side of the second embodiment in a top view.

A table of position arrangement of the first soldering sections and second soldering sections of the second embodiment

| | | | | | | | | | | | | | | | |
|---|---|---|---|---|---|---|---|---|---|---|---|---|---|---|---|
| $1^{st}$ Gnd. Tm. | $2^{nd}$ Gnd. Tm. | $2^{nd}$ Pwr. Tm. | $1^{st}$ Pwr. Tm. | $1^{st}$ Sig. Tm. | $1^{st}$ Sig. Tm. | $1^{st}$ Sig. Tm. | $1^{st}$ Sig. Tm. | $2^{nd}$ Sig. Tm. | $2^{nd}$ Sig. Tm. | $2^{nd}$ Sig. Tm. | $2^{nd}$ Sig. Tm. | $1^{st}$ Pwr. Tm. | $2^{nd}$ Pwr. Tm. | $2^{nd}$ Gnd. Tm. | $1^{st}$ Gnd. Tm. |

Gnd. as grounding;
Pwr. as power;
Sig. as signal;
Tm. as terminal.

In the second embodiment of the instant disclosure, a sequence of the first and second power terminals 20*v*, 40*v* and the first and second grounding terminals 20*g*, 40*g* with respect to the first soldering sections 22 and the second soldering sections 42 from a left side to a right side of the electrical receptacle connector is the first grounding terminal 20*g*, the second grounding terminal 40*g*, the second power terminal 40*v*, the first power terminal 20*v*, the first power terminal 20*v*, the second power terminal 40*v*, the second grounding terminal 40*g* and the first grounding terminal 20*g*.

Figure 12:
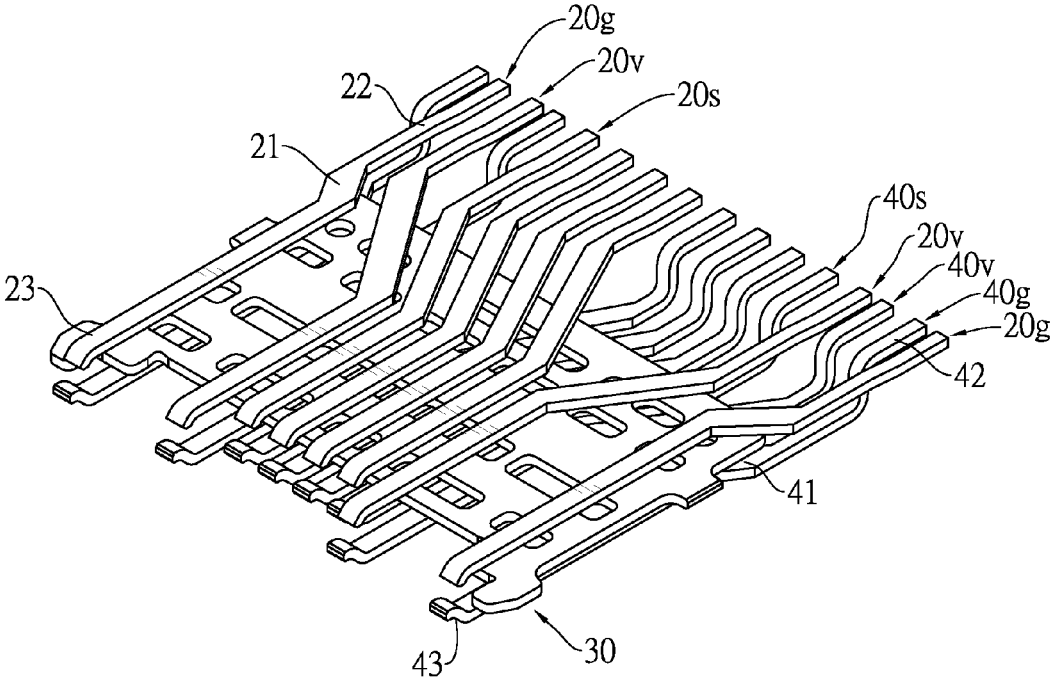
FIG. 12 is a perspective view of a third embodiment of the instant disclosure, showing the first terminal set, the second terminal set and the shielding plate.
Figure 13:
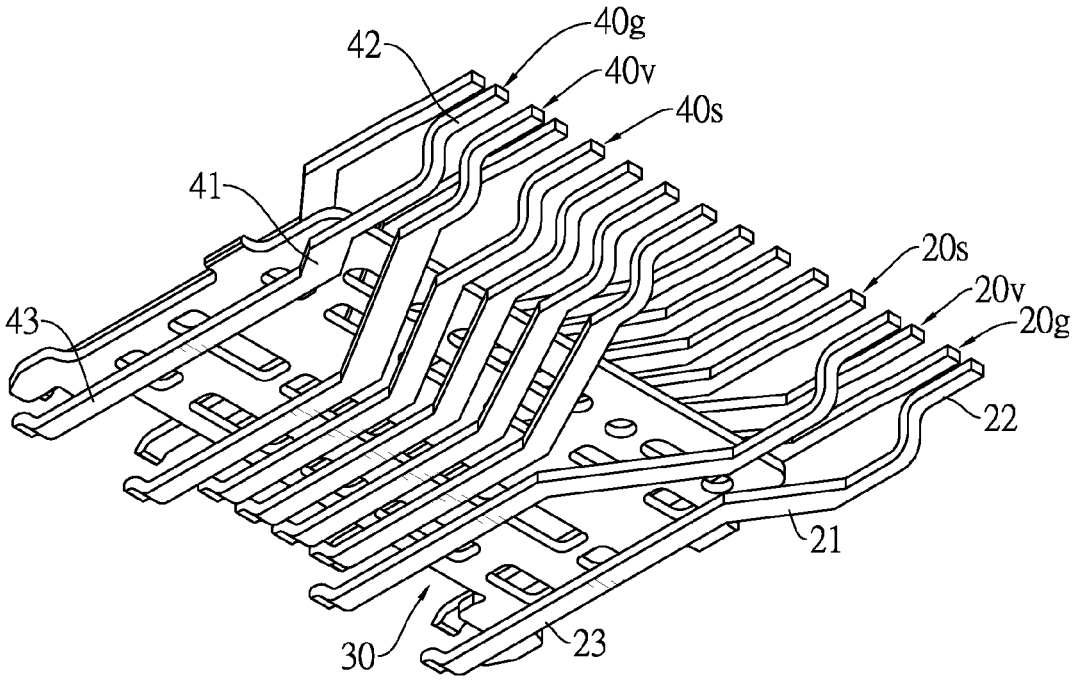
FIG. 13 is another perspective view of the first terminal set, the second terminal set and the shielding plate of the third embodiment of the instant disclosure in FIG. 12.
Figure 14:
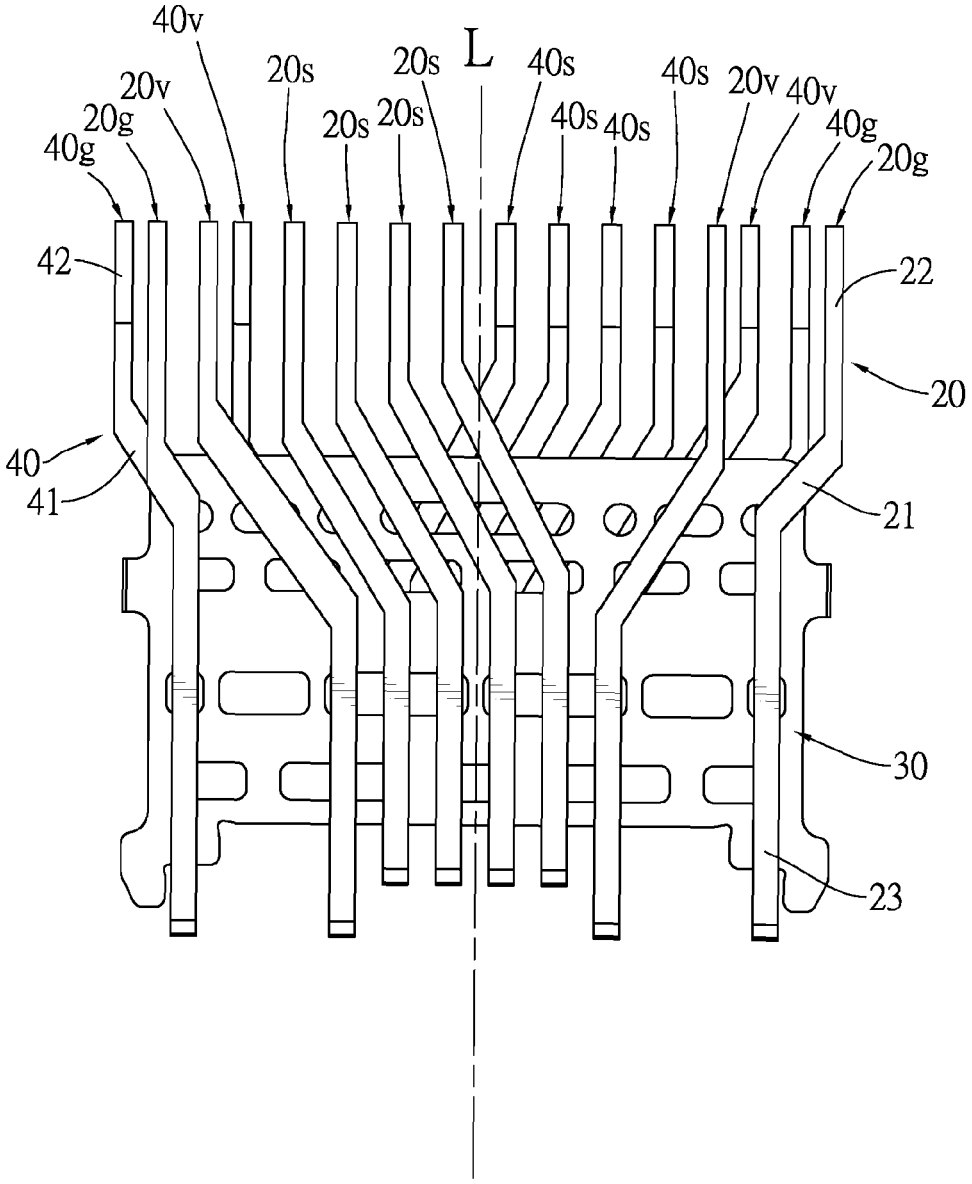
FIG. 14 is a top view of the first terminal set, the second terminal set and the shielding plate of the third embodiment of the instant disclosure in FIG. 12.

With reference to FIGS. 12 to 14, in a third embodiment of the instant disclosure, a relative position between the first soldering section 22 of the first grounding terminal 20*g* that is located on the far left of the first terminal set 20 and the second soldering section 42 of the second grounding terminal 40*g* that is located on the far left of the second terminal set 40 on a left side of a longitudinal axis L that is located in a center of the electrical receptacle connector corresponds to a relative position between the first soldering section 22 of the first grounding terminal 20*g* that is located on the far right of the first terminal set 20 and the second soldering section 42 of the second grounding terminal 40*g* that is located on the far right of the second terminal set 40 on a right side of the longitudinal axis L.

The second soldering section 42 of the second grounding terminal 40*g* and the second soldering section 42 of the second power terminal 40*v* that are located on the far left of the second terminal set 40 are respectively located on a left side and a right side of the first soldering section 22 of the first grounding terminal 20*g* and the first soldering section 22 of the first power terminal 20*v* that are located on the far left of the first terminal set 20.

The second soldering section 42 of the second grounding terminal 40*g* and the second soldering section 42 of the second power terminal 40*v* that are located on the far right of the second terminal set 40 are located between the first soldering section 22 of the first grounding terminal 20*g* and the first soldering section 22 of the first power terminal 20*v* that are located on the far right of the first terminal set 20.

An arrangement of location of the first terminal set 20 and the second terminal set 40 is listed in the following table from the left side to the right side of the third embodiment in a top view.

A table of position arrangement of the first soldering sections and second soldering sections of the third embodiment

| | | | | | | | | | | | | | | | |
|---|---|---|---|---|---|---|---|---|---|---|---|---|---|---|---|
| $2^{nd}$ Gnd. Tm. | $1^{st}$ Gnd. Tm. | $1^{st}$ Pwr. Tm. | $2^{nd}$ Pwr. Tm. | $1^{st}$ Sig. Tm. | $1^{st}$ Sig. Tm. | $1^{st}$ Sig. Tm. | $1^{st}$ Sig. Tm. | $2^{nd}$ Sig. Tm. | $2^{nd}$ Sig. Tm. | $2^{nd}$ Sig. Tm. | $2^{nd}$ Sig. Tm. | $1^{st}$ Pwr. Tm. | $2^{nd}$ Pwr. Tm. | $2^{nd}$ Gnd. Tm. | $1^{st}$ Gnd. Tm. |

Gnd. as grounding;
Pwr. as power;
Sig. as signal;
Tm. as terminal.

In the third embodiment of the instant disclosure, a sequence of the first and second power terminals 20*v*, 40*v* and the first and second grounding terminals 20*g*, 40*g* with respect to the first soldering sections 22 and the second soldering sections 42 from the left side to the right side of the electrical receptacle connector is the second grounding terminal 40*g*, the first grounding terminal 20*g*, the first power terminal 20*v*, the second power terminal 40*v*, the first power terminal 20*v*, the second power terminal 40*v*, the second grounding terminal 40*g* and the first grounding terminal 20*g*.

Figure 15:
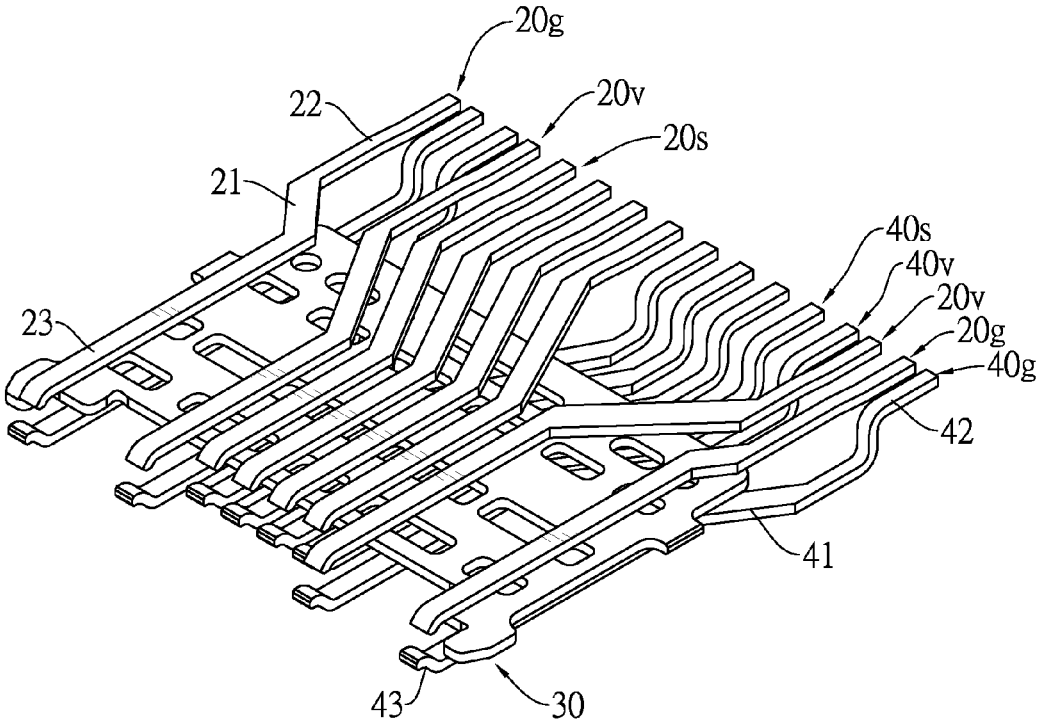
FIG. 15 is a perspective view of a fourth embodiment of the instant disclosure, showing the first terminal set, the second terminal set and the shielding plate.
Figure 16:
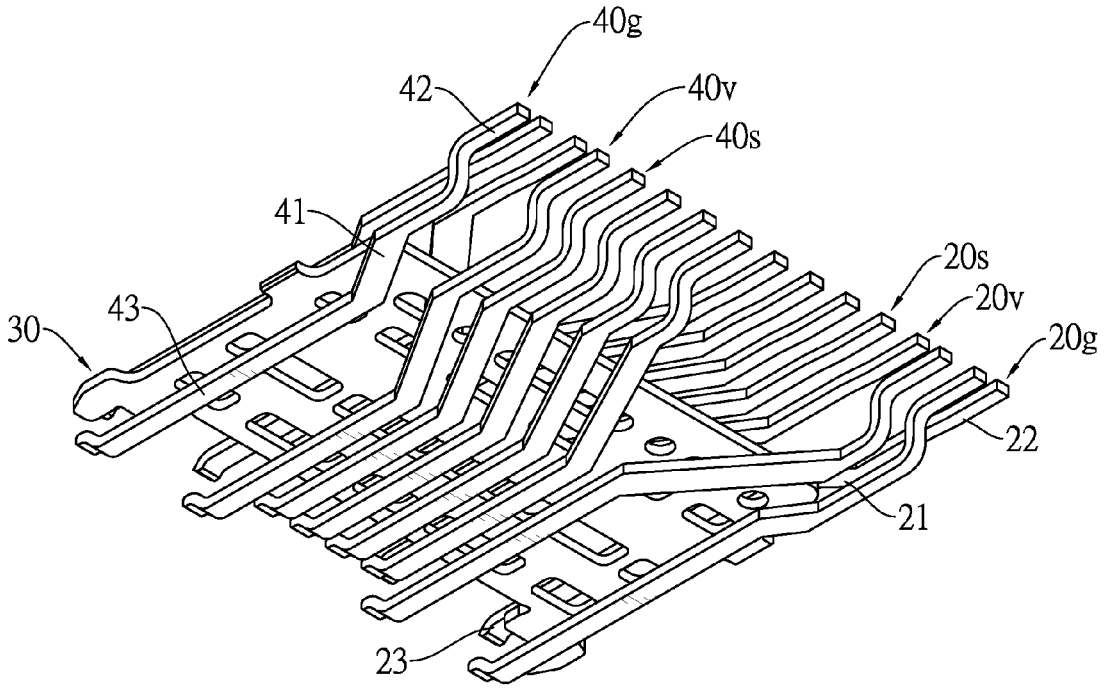
FIG. 16 is another perspective view of the first terminal set, the second terminal set and the shielding plate of the fourth embodiment of the instant disclosure in FIG. 15.
Figure 17:
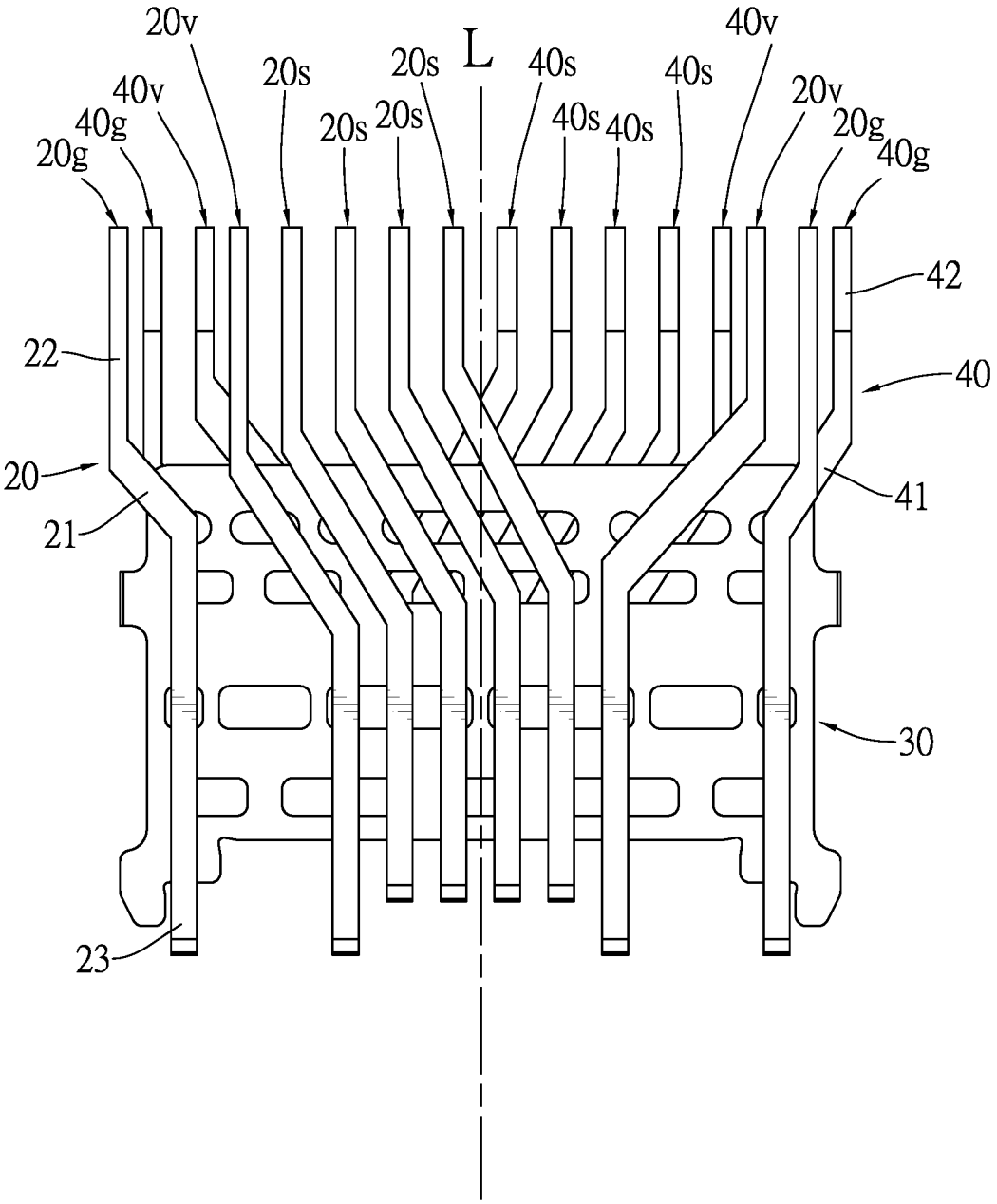
FIG. 17 is a top view of the first terminal set, the second terminal set and the shielding plate of the fourth embodiment of the instant disclosure in FIG. 15.

With reference to FIGS. 15 to 17, in a fourth embodiment of the instant disclosure, a relative position between the first soldering section 22 of the first grounding terminal 20*g* that is located on the far left of the first terminal set 20 and the second soldering section 42 of the second grounding terminal 40*g* that is located on the far left of the second terminal set 40 on the left side of the longitudinal axis L that is located in the center of the electrical receptacle connector corresponds to a relative position between the first soldering section 22 of the first grounding terminal 20*g* that is located on the far right of the first terminal set 20 and the second soldering section 42 of the second grounding terminal 40*g* that is located on the far right of the second terminal set 40 on the right side of the longitudinal axis L.

The second soldering section 42 of the second grounding terminal 40*g* and the second soldering section 42 of the second power terminal 40*v* that are located on the far left of the second terminal set 40 are located between the first soldering section 22 of the first grounding terminal 20*g* and the first soldering section 22 of the first power terminal 20*v* that are located on the far left of the first terminal set 20.

The second soldering section 42 of the second grounding terminal 40*g* and the second soldering section 42 of the second power terminal 40*v* that are located on the far right of the second terminal set 40 are respectively located on a left side and a right side of the first soldering section 22 of the first grounding terminal 20*g* and the first soldering section 22 of the first power terminal 20*v* that are located on the far right of the first terminal set 20.

An arrangement of location of the first terminal set 20 and the second terminal set 40 is listed in the following table from the left side to the right side of the fourth embodiment in a top view.

A table of position arrangement of the first soldering sections and second soldering sections of the fourth embodiment

| | | | | | | | | | | | | | | | |
|---|---|---|---|---|---|---|---|---|---|---|---|---|---|---|---|
| $1^{st}$ Gnd. Tm. | $2^{nd}$ Gnd. Tm. | $2^{nd}$ Pwr. Tm. | $1^{st}$ Pwr. Tm. | $1^{st}$ Sig. Tm. | $1^{st}$ Sig. Tm. | $1^{st}$ Sig. Tm. | $1^{st}$ Sig. Tm. | $2^{nd}$ Sig. Tm. | $2^{nd}$ Sig. Tm. | $2^{nd}$ Sig. Tm. | $2^{nd}$ Sig. Tm. | $2^{nd}$ Pwr. Tm. | $1^{st}$ Pwr. Tm. | $1^{st}$ Gnd. Tm. | $2^{nd}$ Gnd. Tm. |

Gnd. as grounding;
Pwr. as power;
Sig. as signal;
Tm. as terminal.

In the fourth embodiment of the instant disclosure, a sequence of the first and second power terminals 20*v*, 40*v* and the first and second grounding terminals 20*g*, 40*g* with respect to the first soldering sections 22 and the second soldering sections 42 from a left side to a right side of the electrical receptacle connector is the first grounding terminal 20*g*, the second grounding terminal 40*g*, the second power terminal 40*v*, the first power terminal 20*v*, the second power terminal 40*v*, the first power terminal 20*v*, the first grounding terminal 20*g* and the second grounding terminal 40*g*.

The electrical receptacle connector of the instant disclosure has advantages as follows:

(1) The first soldering sections 22 are aligned with the second soldering sections 42 in a row. The first soldering section 22 of the first grounding terminal 20*g* and the second soldering section 42 of the second grounding terminal 40*g* that are located on the same side of the connector of the instant disclosure are clustered together. Therefore, the first soldering section 22 and the second soldering section 42 are soldered simultaneously in the soldering process. Thus, the soldering process is simplified and reduces "solder skip" that is caused by insufficient solder or effluence of solder and "short circuit".

(2) The first terminal set 20 and the second terminal set 40 are symmetrical along the longitudinal axis L. The relative position between the first terminal set 20 and the second terminal set 40 on a left side of the longitudinal axis L corresponds to the relative position between the first terminal set 20 and the second terminal set 40 on a right side of the longitudinal axis L. Therefore, structures of molds of the terminals are simplified.

(3) The first soldering sections 22 and the second soldering sections 42 are arranged in a row. Thus, a length of the electrical receptacle connector and a length of a circuit board that is mounted on the instant disclosure are reduced. Then, the dimensions of the connector of the instant disclosure and the dimensions of the circuit board are reduced.

Even though numerous characteristics and advantages of the instant disclosure have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An electrical receptacle connector comprising:

an insulated housing comprising a base portion; and a tongue portion extending from the base portion;

a first terminal set held in the insulated housing, disposed on a top surface of the tongue portion and including two first grounding terminals;

two first power terminals; and multiple first signal terminals, wherein each one of the first grounding terminals, the first power terminals and the first signal terminals has a first connection section;

a first soldering section extending from one of two ends of the first connection section, wherein the two first soldering sections of the two first grounding terminals are respectively located on a far left and a far right of the first terminal set, the two first soldering sections of the two first power terminals are disposed between the two first soldering sections of the two first grounding terminals and are respectively located next to the two first soldering sections of the two first grounding terminals; and a first contact section extending from the other end of the first connection section;

a second terminal set held in the insulated housing, disposed on a bottom surface of the tongue portion and including two second grounding terminals;

two second power terminals; and multiple second signal terminals, wherein each one of the second grounding terminals, the second power terminals and the second signal terminals has a second connection section;

a second soldering section extending from one of two ends of the second connection section, wherein the two second soldering sections of the two second grounding terminals are respectively located on a far left and a far right of the second terminal set, the two second soldering sections of the two second power terminals are disposed between the two second soldering sections of the two second grounding terminals and are respectively located next to the two second soldering sections of the two second grounding terminals; and a second contact section extending from the other end of the second connection section; and a metallic shell surrounding the insulated housing and having a receiving cavity defined through the metallic shell and receiving the insulated housing, the first terminal set and the second terminal set;

wherein the second soldering sections of the second terminal set are aligned with the first soldering sections of the first terminal set at a same horizontal plane, the two second soldering sections of the two second grounding terminals are respectively located adjacent to the two first soldering sections of the two first grounding terminals, and the two second soldering sections of the two second power terminals are respectively located adjacent to the two first soldering sections of the two first power terminals.

2. The electrical receptacle connector as claimed in claim 1, wherein the first soldering section of the first grounding terminal and the first soldering section of the first power terminal that are located on the far left of the first terminal set are symmetrical with the first soldering section of the first grounding terminal and the first soldering section of the first power terminal that are located on the far right of the first terminal set along a longitudinal axis located in a center of the electrical receptacle connector;

the second soldering section of the second grounding terminal and the second soldering section of the second power terminal that are located on the far left of the second terminal set are symmetrical with the second soldering section of the second grounding terminal and the second soldering section of the second power terminal that are located on the far right of the second terminal set along the longitudinal axis;

the second soldering section of the second grounding terminal and the second soldering section of the second power terminal that are located on the far left of the second terminal set are respectively located at a left side and a right side of the first soldering section of the first grounding terminal and the first soldering section of the first power terminal that are located on the far left of the first terminal set; and the second soldering section of the second grounding terminal and the second soldering section of the second power terminal that are located on the far right of the second terminal set are respectively located at a left side and a right side of the first soldering section of the first grounding terminal and the first soldering section of the first power terminal that are located on the far right of the first terminal set.

3. The electrical receptacle connector as claimed in claim 1, wherein the first soldering section of the first grounding terminal and the first soldering section of the first power terminal that are located on the far left of the first terminal set are symmetrical with the first soldering section of the first grounding terminal and the first soldering section of the first power terminal that are located on the far right of the first terminal set along a longitudinal axis located in a center of the electrical receptacle connector;

the second soldering section of the second grounding terminal and the second soldering section of the second power terminal that are located on the far left of the second terminal set are symmetrical with the second soldering section of the second grounding terminal and the second soldering section of the second power terminal that are located on the far right of the second terminal set along the longitudinal axis;

the second soldering section of the second grounding terminal and the second soldering section of the second power terminal that are located on the far left of the second terminal set are located between the first soldering section of the first grounding terminal and the first soldering section of the first power terminal that are located on the far left of the first terminal set; and the second soldering section of the second grounding terminal and the second soldering section of the power terminal that are located on the far right of the second terminal set are located between the first soldering section of the first grounding terminal and the first soldering section of the first power terminal that are located on the far right of the first terminal set.

4. The electrical receptacle connector as claimed in claim 1, wherein a relative position between the first soldering section of the first grounding terminal that is located on the far left of the first terminal set and the second soldering section of the second grounding terminal that is located on the far left of the second terminal set on a left side of a longitudinal axis that is located in a center of the electrical receptacle connector corresponds to a relative position between the first soldering section of the first grounding terminal that is located on the far right of the first terminal set and the second soldering section of the second grounding terminal that is located on the far right of the second terminal set on a right side of the longitudinal axis;

the second soldering section of the second grounding terminal and the second soldering section of the second power terminal that are located on the far left of the second terminal set are respectively located on a left side and a right side of the first soldering section of the first grounding terminal and the first soldering section of the first power terminal that are located on the far left of the first terminal set; and the second soldering section of the second grounding terminal and the second soldering section of the second power terminal that are located on the far right of the second terminal set are located between the first soldering section of the first grounding terminal and the first soldering section of the first power terminal that are located on the far right of the first terminal set.

5. The electrical receptacle connector as claimed in claim 1, wherein a relative position between the first soldering section of the first grounding terminal that is located on the far left of the first terminal set and the second soldering section of the second grounding terminal that is located on the far left of the second terminal set on a left side of a longitudinal axis that is located in a center of the electrical receptacle connector corresponds to a relative position between the first soldering section of the first grounding terminal that is located on the far right of the first terminal set and the second soldering section of the second grounding terminal that is located on the far right of the second terminal set on a right side of the longitudinal axis;

the second soldering section of the second grounding terminal and the second soldering section of the second power terminal that are located on the far left of the second terminal set are located between the first soldering section of the first grounding terminal and the first soldering section of the first power terminal that are located on the far left of the first terminal set; and the second soldering section of the second grounding terminal and the second soldering section of the second power terminal that are located on the far right of the second terminal set are respectively located on a left side and a right side of the first soldering section of the first grounding terminal and the first soldering section of the first power terminal that are located on the far right of the first terminal set.

6. The electrical receptacle connector as claimed in claim 2, wherein a sequence of the first and second power terminals and the first and second grounding terminals with respect to the first soldering sections and the second soldering sections from the left side to the right side of the electrical receptacle connector is the second grounding terminal, the first grounding terminal, the first power terminal, the second power terminal, the second power terminal, the first power terminal, the first grounding terminal and the second grounding terminal.

7. The electrical receptacle connector as claimed in claim 3, wherein a sequence of the first and second power terminals and the first and second grounding terminals with respect to the first soldering sections and the second soldering sections from the left side to the right side of the electrical receptacle connector is the first grounding terminal, the second grounding terminal, the second power terminal, the first power terminal, the first power terminal, the second power terminal, the second grounding terminal and the first grounding terminal.

8. The electrical receptacle connector as claimed in claim 4, wherein a sequence of the first and second power terminals and the first and second grounding terminals with respect to the first soldering sections and the second soldering sections from the left side to the right side of the electrical receptacle connector is the second grounding terminal, the first grounding terminal, the first power terminal, the second power terminal, the first power terminal, the second power terminal, the second grounding terminal and the first grounding terminal.

9. The electrical receptacle connector as claimed in claim 5, wherein a sequence of the first and second power terminals and the first and second grounding terminals with respect to the first soldering sections and the second soldering sections from a left side to a right side of the electrical receptacle connector is the first grounding terminal, the second grounding terminal, the second power terminal, the first power terminal, the second power terminal, the first power terminal, the first grounding terminal and the second grounding terminal.

10. The electrical receptacle connector as claimed in claim 1, wherein the first soldering sections of the first signal terminals of the first terminal set are clustered together.

11. The electrical receptacle connector as claimed in claim 1, wherein the second soldering sections of the second signal terminals of the second terminal set are clustered together.

12. The electrical receptacle connector as claimed in claim 1, wherein the electrical receptacle connector further has a shielding plate embedded inside the insulated housing and located between the first terminal set and the second terminal set.

13. The electrical receptacle connector as claimed in claim 1, wherein the electrical receptacle connector is accommodated to a Universal Serial Bus (USB) Type-C Cable and Connector Specification.

14. The electrical receptacle connector as claimed in claim 2, wherein the first soldering sections of the first signal terminals of the first terminal set are clustered together.

15. The electrical receptacle connector as claimed in claim 2, wherein the second soldering sections of the second signal terminals of the second terminal set are clustered together.

16. The electrical receptacle connector as claimed in claim 2, wherein the electrical receptacle connector further has a shielding plate embedded inside the insulated housing and located between the first terminal set and the second terminal set.

17. The electrical receptacle connector as claimed in claim 2, wherein the electrical receptacle connector is accommodated to a USB Type-C Cable and Connector Specification.

18. The electrical receptacle connector as claimed in claim 3, wherein the first soldering sections of the first signal terminals of the first terminal set are clustered together.

* * * * *